US007891512B2

(12) United States Patent
Brosius

(10) Patent No.: US 7,891,512 B2
(45) Date of Patent: Feb. 22, 2011

(54) LINERLESS CLOSURE FOR A CONTAINER

(75) Inventor: James Ralph Brosius, St. Louis, MO (US)

(73) Assignee: Reckitt Benckiser Inc., Parsippany, NJ (US)

( * ) Notice: Subject to any disclaimer, the term of this patent is extended or adjusted under 35 U.S.C. 154(b) by 642 days.

(21) Appl. No.: 11/742,201

(22) Filed: Apr. 30, 2007

(65) Prior Publication Data

US 2008/0135514 A1 Jun. 12, 2008

Related U.S. Application Data

(60) Provisional application No. 60/868,800, filed on Dec. 6, 2006.

(51) Int. Cl.
*B65D 53/00* (2006.01)

(52) U.S. Cl. ..... 215/344

(58) Field of Classification Search ..... 215/344, 215/343, 341, 364, 356, 355, 337, 329, 42, 215/45, 44, 43, 40, 316, 200, 354; 220/803, 220/802, 801, 796, 792, 780, 293, 288, FOR. 109, 220/FOR. 108, FOR. 105, 200; D9/439, D9/435, 434

See application file for complete search history.

(56) References Cited

U.S. PATENT DOCUMENTS 2,952,374 A * 9/1960 Pryale ..... 215/329
3,055,526 A * 9/1962 Plunkett ..... 215/329
3,067,900 A * 12/1962 Kessler ..... 215/260
3,151,757 A * 10/1964 Martin ..... 215/260
3,255,907 A * 6/1966 Eddy ..... 215/329
3,255,909 A 6/1966 Miller et al.
3,414,151 A * 12/1968 Morrison ..... 215/344
3,632,005 A * 1/1972 Kessler ..... 215/344
3,747,792 A * 7/1973 Anthony ..... 215/344
3,865,263 A * 2/1975 Birch ..... 215/321
4,072,244 A * 2/1978 Mueller ..... 215/344
4,106,654 A * 8/1978 Jones ..... 215/329
4,122,965 A 10/1978 Roy
4,147,268 A * 4/1979 Patel et al. ..... 215/252
4,190,171 A * 2/1980 Kulle et al. ..... 215/329

(Continued)

FOREIGN PATENT DOCUMENTS

EP 2839296 A1 11/2002

*Primary Examiner*—Anthony Stashick
*Assistant Examiner*—Robert J Hicks
(74) *Attorney, Agent, or Firm*—Norris McLaughlin & Marcus, PA

(57) ABSTRACT

A linerless closure mounted on a container, the closure comprising a closure top having a depending sidewall which terminates at a bottom end, the sidewall having an exterior face from which depends a circumferential skirt which extends outwardly from the sidewall having an interior skirt sidewall and an interior top surface which defines a junction space between the exterior face and the skirt, the junction space includes a tapered circumferential sidewall, wherein said closure excludes any flexible or elastomeric intermediate element which is not an integrally molded or formed as a part of the closure, said closure top mounted on a container, the container having a neck, the neck having an outer surface, a top surface and an edge defined by the intersection of the outer surface and the top surface, wherein the neck is in a direct, seal-tight contact with the tapered circumferential sidewall of the cap.

12 Claims, 4 Drawing Sheets

U.S. PATENT DOCUMENTS 4,206,852 A * 6/1980 Dunn et al. ..... 215/252
4,351,443 A 9/1982 Uhlig
4,489,845 A * 12/1984 Aichinger et al. ..... 215/329
4,526,284 A * 7/1985 Herbert ..... 215/329
4,560,077 A * 12/1985 Dutt ..... 215/307
4,566,603 A * 1/1986 Moore ..... 215/329
4,798,303 A * 1/1989 Arnold ..... 215/329
5,161,707 A * 11/1992 Dutt et al. ..... 215/344
5,275,287 A * 1/1994 Thompson ..... 215/344
5,803,286 A * 9/1998 Pfefferkorn et al. ..... 215/307
6,126,027 A * 10/2000 Thompson ..... 215/354
2005/0263476 A1 * 12/2005 Harrison et al. ..... 215/44
2006/0138071 A1 * 6/2006 Tsutsumi et al. ..... 215/252

* cited by examiner

LINERLESS CLOSURE FOR A CONTAINER

This application claims priority from U.S. Ser. No. 60/868,800 filed 06 Dec. 2006

The present application relates generally to a linerless closure as well as to the combination of a container and a linerless closure.

The closure industry has long sought a closure which would effectively seal a container from leakage of liquid contents without the necessity of providing such closure with a gasket. There are numerous linerless closures on the market as well as patents relating to molded plastic linerless closures; however, none have been completely effective in producing a leak-proof seal between the container to which it is affixed and the sealing element of the closure. To be completely effective, it is necessary that the seal between the closure and its associated container be liquid-tight not only upon the initial application of the closure to the container but also upon resealing.

Many linerless closures presently known to the art rely upon a downwardly and inwardly directed sealing fin which depends from the closure top panel to effect a sealing engagement with the container. Such inwardly directed sealing fin engages the rim of its associated container and, as the closure is tightened thereon, is forced upwardly toward the closure top panel. The upward movement of the sealing fin causes the lower marginal edge thereof to be urged inwardly toward the longitudinal axis of the closure skirt, thereby reducing the diameter of the circle defined by such sealing fin lower marginal edge. As a result, the lower portion of the sealing fin becomes wrinkled or corrugated thereby preventing the attainment of an effective seal.

Other types of linerless closures have various styles and configurations of sealing fins, some of which rest directly on the top of the rim of the container mouth to which the closure is affixed and others which fit within the mouth of the container. While many of these linerless closures are satisfactory in some respects, none have met with widespread acceptance because they are either too complicated and too expensive or they simply do not provide an effective seal particularly following multiple resealing of a container with a closure.

As pointed out above, one of the essential requirements of a linerless closure is that it be effective upon resealing. Thus, it is highly desirable to use linerless closures in the packaging of articles and especially liquid or other fluid compositions that only a portion of the contents are dispensed from the container at each use, the container then being reclosed to await the next use. It is obvious that the failure of such closure to attain a liquid-tight seal with its associated container upon reapplication thereto makes the closure virtually worthless.

Accordingly, it is an important object of this invention to provide a closure-container combination which will be highly effective in providing a liquid-tight seal both upon the initial application of the closure to the container and upon resealing.

More particularly, it is an object of the present invention to provide the above combination characterized in that the sealing contact between the closure and the container extends over a substantial peripheral area, preferably a complete peripheral contact area between the closure and the container.

It is a further object of the present invention to provide a linerless closure which provides an effective seal on a container neck. The closure may be used for all types of materials which may be contained within, and dispensed from said container. Without limitation such materials include liquids, semi-solids (gels), particulate solids such as powders, pellets, prills etc. as well as other fluids (including gases) and for that matter any article or material which can be dispensed from the container neck.

Additional objects and advantages of the present invention will become readily apparent from the following detailed description taken in conjunction with the annexed sheet of drawings on which:

Figure 1:
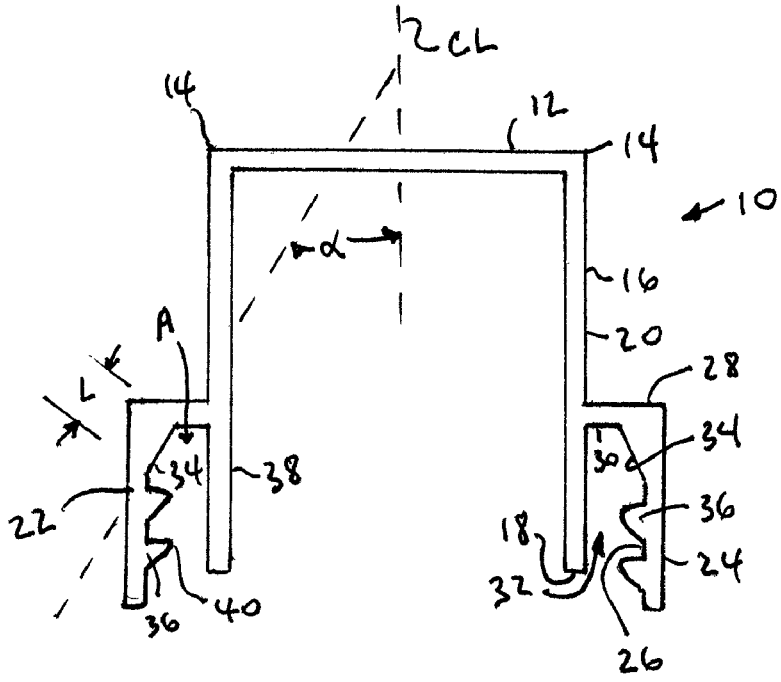
FIG. 1 is a sectional elevational view of a first embodiment of a closure according to the present invention.

According to the invention, an effective liquid tight seal can be achieved solely by providing a closure according to the invention which is adapted to, or configured to achieve a cooperative engagement of at least a portion of a container, typically the neck of a container, via contact with a portion of the closure without the necessity for an intermediate element which is not an integrally molded for formed part of a closure, such as a gasket, washer, seal, or the like which is flexible or elastomeric in nature. Rather, the liquid tight seal can be achieved directly between the closure and a portion of the container, typically the peripheral edge or rim of a neck portion thereon which engages directly with a correspondingly configured portion of the closure when the said closure is properly engage on the container. The closure and container are resealable and provides for an effective liquid tight seal even after plural uses, even in the absence of a flexible or elastomeric element intermediate the closure and the container.

The elimination of an intermediate element, such as a gasket, washer, seal, or the like which is generally flexible or elastomeric in nature which is commonly found in the art of closures provides a simplification of the construction of such closures as well as reduced costs as the closures of the invention may be easily molded in a single step operation, such as per a conventional injection molding operation wherein the closure is formed of a synthetic thermoplastic polymer. The closures of the invention also provide for the elimination of an intermediate element which may be provided as part of the container which also functions as, or provides a flexible or elastomeric seal means such as a gasket, washer, seal or the like which is not integrally molded or formed as part of the container but is rather provided as a separate element which may be finable in the neck of a container in order to provide an improved seal with a closure. Rather, in particularly preferred embodiments, the closures of the present invention provide an excellent seal by direct contact with part of the closure and at least a part of the container, especially a neck or opening of the container without the need for an intermediate elastomer or flexible.

While the closures of the invention may be formed of any of a variety of materials, as all materials which may be fashioned to form a closure may be used, advantageously the use of a synthetic polymers including thermosettable or thermoformable synthetic polymers such as are widely used in casting or injection molding. Exemplary synthetic polymers such as polyamides, polyolefins (e.g., polypropylene, polyethylene) as well as polyalkyleneterephalates (i.e., polyethylene terephthalate, polybutylene terephthalate), polystyrenes, polysulfones, polycarbonates as well as copolymers formed from monomers of one or more of the foregoing being several nonlimiting examples of useful synthetic polymers. Desirably the material of construction of the closure is selected also as to not be deleteriously affected by the contents of the container which are to be used with the closure. In the case where such contents are chemical compositions, e.g., aqueous or non-aqueous liquid compositions which comprise one or more surfactants, solvents, etc., the use of a synthetic polymer which is essentially chemically inert to such compositions is preferably used.

The closure finds particular use for providing a liquid tight seal with bottles or other containers which include a neck and which have been formed by a blow-molding process from a synthetic polymer, e.g., polypropylene, polyethylene. Very commonly, following the blow-molding process step, during the subsequent cooling step the terminal end of the neck suffers some warpage which may cause the periphery of the terminal end of the neck to be irregular or non-planar. This phenomenon is widely known in the relevant art and has in the past necessitated the use of closures which include an intermediate element, such as a gasket, washer, seal, or the like which is flexible or elastomeric in nature which intermediate element at least partially deforms to adapt to the contours of the irregular or non-planar of the terminal end of the neck and thereby provide a liquid tight seal. Such an intermediate element is not required by the closures of the present invention, and yet, it has been surprisingly discovered that a good and resealable liquid tight seal may be provided over repeated sealing and resealing operations.

The invention including certain preferred embodiments are described in the following. In the accompanying figures, like elements are indicated using the same numerals throughout the figures.

Turning now to FIG. 1 there is depicted a first embodiment of a closure according to the present invention. The closure top 12 has depending from its peripheral edges 14 a downwardly depending cylindrical sidewall 16. The sidewall 16 terminates at a bottom end 18 and on its exterior face and depending therefrom further includes a circumferential skirt 22. The skirt extends outwardly from the sidewall 16 and is connected thereto at a point intermediate the peripheral edge 14 and the bottom end 18 of the sidewall 16. Preferably, as depicted in FIG. 1, the skirt 22, the sidewall 16 and the center point of the top panel 12 are all concentric about a central axis "CL".

The skirt 22 includes an exterior skirt sidewall 24 and interior skirt sidewall 26, an exterior top surface 28 and an interior top surface 30. A region between the exterior face of the sidewall, the interior top surface 30 of the skirt 24 and the interior skirt sidewall 26 define a junction space 32 which is adapted to receive a portion of a threaded container neck (not shown).

As can be seen with a careful eye to FIG. 1, there is also provided a tapered circumferential sidewall 34 which in the figures extends from a point on the interior surface 30 of the skirt 34 and extends downwardly and outwardly where it contacts the interior skirt sidewall above one or more mating threads 36 which extend inwardly, that is to say towards the center line "CL" from the interior skirt sidewall. As is readily understood from a review of FIG. 1, the portion of the junction space 32 immediately adjacent to the interior top surface 30, that portion of the sidewall 16 adjacent to the interior top surface 30, the circumferential sidewall 34 defines a frusto-conical cavity "A". The purpose of this frusto-conical cavity "A" will be defined and discussed in more detail with reference to following figures.

The tapered circumferential sidewall 34 is, in preferred embodiments, also concentric with the center line "CL". The tapered circumferential sidewall 34 also preferably forms an angle, "alpha" with respect to the center line which is between about 5°-45°, more preferably between about 5°-30°, yet more preferably between about 7°-25°, still more preferably between about 10°-25° as measured with respect to the center line "CL". Conveniently, in preferred embodiments as the interior face 38 of the sidewall 16 is also concentric with the center line "CL", the angle alpha can also be measured with respect to the interior face 38.

The tapered circumferential sidewall 34 also has a length "L". This length "L" is measured between the intersection of said tapered circumferential sidewall 34 with the interior top surface 30 and the interior skirt sidewall 26 of the skirt 22. Preferably, the circumferential sidewall 34 is in a position where it is above, that is to say toward the top panel 12, of the mating threads 36, and yet is within the junction space 32. Preferably, the point or line of intersection of the tapered circumferential sidewall 34 with the interior top surface 30 is such that it is closer to the center line, or alternately closer to the exterior face 20 of the sidewall 16 than are the peaks 40, the mating threads. In this way, a viewer, looking into the interior space "A" would not find that the peaks of the mating threads 40 obscure the point or line of this junction.

The operation of the embodiment of the linerless closure 10 is described in more detail with reference to FIG. 2.

Figure 2:
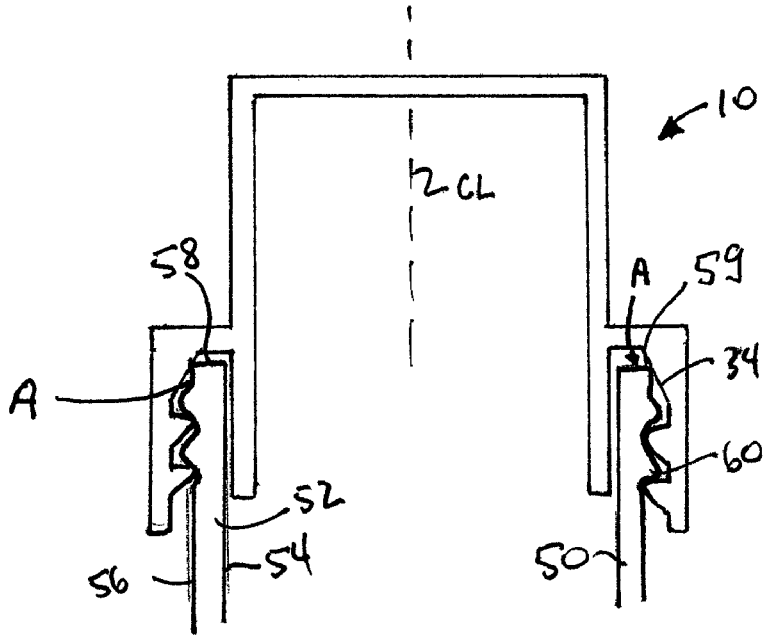
FIG. 2 is a sectional elevational view showing the closure of FIG. 1 engaged on a container neck.

FIG. 2 depicts in a sectional elevational view the embodiment according to FIG. 1, but mounted on a portion of a container. This figure also illustrates the interrelation of the closure 10, and the container 50. As is seen from a careful review of FIG. 2, the container 50 includes a neck 52 having an inner surface 54, an outer surface 56 and intermediate thereto and at the ends thereof a top surface 58. In the embodiment depicted on FIG. 2, the top surface 50 is usually perpendicular to both the inner surface 54 and the outer surface, of the neck 52 however this is not an essential feature albeit it is amongst the preferred embodiments. Integrally formed to, or depending from the outer surface 56 are a series of corresponding mating threads 60 which are suitably dimensioned to engage the mating threads 36 of the closure 10. These outer mating threads, as seen in FIG. 2, extend around the exterior periphery of the neck 52 of the container 50, and are at a position beneath the top surface 58.

On a closer view of FIG. 2, it is seen that the closure 10 is mounted upon the container 50 in a liquid-tight relationship. However, as can be seen, the junction between the mating threads 36 and 60 do not provide a primary seal. Rather, it can be seen that the exterior circumferential edge 59 which is the point at the intersection between the top surface 58 and the outer surface 56 of the neck 52, is in a seal-tight contact with the tapered circumferential sidewall 34. Thus, it is seen that at least a part of the neck 52 of the container 50 is directly compressed against the circumferential sidewall particularly in the region of the frustro-conical cavity A in such a manner that a good liquid-tight seal is formed directly therebetween without the need for an intermediate element. With further rotation of the closure 10 on the neck 52 it is expected that the top surface 58 would be further displaced and biased or flexed towards the center line CL of the closure 10 thus slightly deforming the end of the neck 52 in the region of the top surface 58. Theoretically the actual circumference of the top surface 58 of the neck 52 is reduced by such compression as the closure 10 is further engaged or tightened on the neck. This is due to the fact that further vertical displacement of the closure 10 and its frustro-conical cavity A in a downward direction, that is to say in the direction of the bottle 50 or other container causes for the presentation of surfaces of the tapered circumferential sidewall 34 which are of increasingly reducing circumference as the closure 10 continues to be tightened on the neck, causing both a temporary reduction in the diameter of the neck 52 at the region of the top surface 58, and an increase in compression at the points of contact of the top surface 58 and the tapered circumferential sidewall 34. In this manner, the inventor has surprisingly found that an effective, liquid-tight seal which is attained without the use of an intermediate sealing member, such as an elastomeric element or elastomeric surface, i.e. an o-ring, washer, or the like, can be attained. Such is a surprising result, and also a beneficial one. The inventors have long known that the formation of larger containers, such as one-liter and greater capacity volume bottles such as are typically used with laundry and other fabric treatment products are made from blow molded polymers which, while are generally accurately formed during the blow molding process almost invariably suffer dimensional shrinkage following cooling of the polymer. Such is particularly detrimental in that such shrinkage usually results in warpage of the neck of such bottles such that the top surface 58 of the neck 52 is rarely planar but rather, may have a slight degree of undulation. Such undulation in the past has always necessitated the use of an intermediate liner or other sealing means such as one or more of the elastomeric elements discussed immediately above. This was due to compensate for such undulations when a closure was applied to such a neck. However, in accordance with the present invention such can be obviated and in preferred embodiments, an intermediate further element such as a liner, or elastomeric element intermediate the contact between the neck of the container and the cap can be omitted and in specific particularly preferred embodiments is expressly excluded.

In preferred embodiments, wherein at least one of the closure 10 and/or the container 50 are formed from a synthetic polymer, the synthetic polymer has a slight degree of flexural strength wherein, due to the tightening in the engagement of the corresponding mating threads 36, 60, the exterior circumferential edge 59 is urged against and contacts the tapered circumferential sidewall 34 and is compressed against the same.

Figure 3:
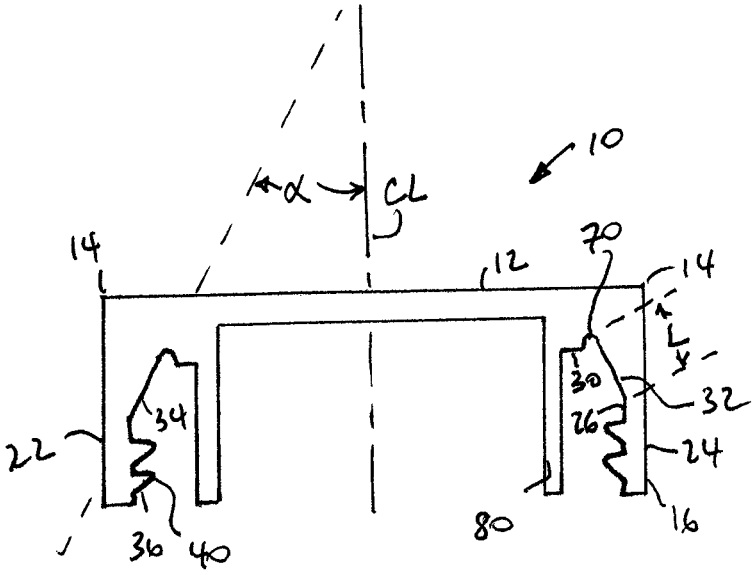
FIG. 3 is a sectional elevational view of a second embodiment of a closure according to the present invention.

Turning now to FIG. 3, there is depicted a sectional elevational view of a second embodiment of a closure 10 according to the present invention.

In this embodiment, many of the features of this second embodiment are common to the first embodiment discussed above. With regard to FIG. 3, and the embodiment of the closure 10 shown thereon, the closure also includes a top panel 12 having depending therefrom a sidewall 16 extending downward from the peripheral edges 14 of the top panel 12. In this embodiment, unlike that of the embodiments of FIGS. 1 and 2, the circumferential skirt 22 is "merged" with the sidewall 16 of the closure 10. Indeed, it can be said that the circumferential skirt 22 extends directly downwardly from the top panel 12 of the closure 10. As is depicted, the circumferential skirt 22 includes an exterior skirt sidewall 24, an interior skirt sidewall 26 having extending therefrom mating threads 36 which extend toward the center line "CL". Also present in FIG. 3 is an inner sidewall 80 which is circumferential and depends from the top panel 12; the inner sidewall 80 is inwardly, that is to say closer to the center line "CL" than is the circumferential skirt 22. In operation, it can be understood that the inner sidewall 80 is analogous to and performs the same function as that portion of the sidewall depicted on FIG. 1 which extended downwardly beneath the exterior top surface 28 as depicted on FIG. 1. The current embodiment according to FIG. 3 is thus understood to be essentially very similar to that depicted on FIG. 1 but for the fact that the overall dimensions, namely the height of the closure 10 is substantially reduced with respect to that embodiment depicted on FIG. 1. Similarly, the operation of the closure 10 according to FIG. 3 functions akin to that of the closure 10 described with reference to FIGS. 1 and 2.

The embodiment of FIG. 3 however includes a further element which is adjacent to the tapered circumferential sidewall shown on the figure. This additional element is a circumferential recess 70 which is integrally formed as part of the closure and is essentially a cavity which is concentric with the center line "CL" of the closure. This recess 70 extends upwardly, that is to say toward the top panel from the junction space 32 and is found at the intersection between the interior top surface 30 and the tapered circumferential sidewall 34 of the closure 10. As depicted on FIG. 3, and in accordance with preferred embodiments the dimensions of the circumferential recess 70 and its position with respect to the center line and the other elements of the closure 10 are such that the circumferential recess is closer to the center line than are the peaks 40 of the mating threads 36. In this manner, a viewer looking into the interior of the junction space would note that the peaks 40 of the mating threads 36 do not obscure the circumferential recess 70. Additionally, the circumferential recess is preferably immediately adjacent to, or is even more preferably merged with a portion of the tapered circumferential sidewall 34 such that, the dimensions of the circumferential recess 70 effectively extend the length "L" such that the top junction between the circumferential recess and the merged tapered circumferential sidewall 34 is closer to the top panel 12 than is the interior top surface 30 of the circumferential skirt 22.

Figure 4:
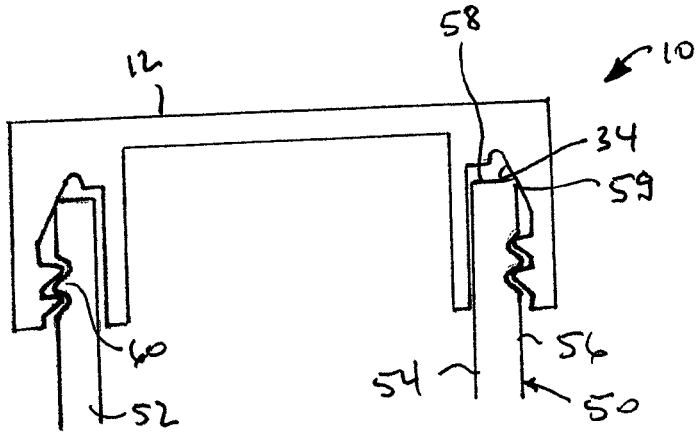
FIG. 4 is a sectional elevational view showing the embodiment of FIG. 3 engaged on a container neck.

Turning now to FIG. 4, there is depicted in a sectional elevational view the embodiment of the closure 10 depicted on FIG. 3 mounted upon the neck 52 of a container 50. Again, as is akin to the description accompanying FIG. 2, the container 50 includes a neck 52, said neck having an inner surface 54, an outer surface 56 bearing on said outer surface or integrally formed said outer surface a series of corresponding mating threads 60 which are suitably dimensioned to engage with the mating threads 36 of the closure 10. At the end of the neck and intermediate the inner surface 54 and the outer surface 56 is a top surface 58.

In use, user would affix the rotational movement the closure 10 by sufficiently rotating the closure with respect to the container 50 so to cause engagement of the mating threads 36, 60 thereby urging the closure 10 onto the container 50. Rotation continues, until the exterior circumferential edge 59 is urged against the tapered circumferential sidewall 34 and forms a liquid-tight seal therewith due to compression between the neck 52 and the said tapered circumferential sidewall 34, in the manner discussed in more detail with reference to FIG. 1. In this embodiment, the circumferential recess does not provide an additional function as it does not contact the neck 52 or any portion thereof however, in further embodiments to be described, portions of the neck 52 may engage and enter into this circumferential recess. Further, the use of a circumferential recess 70 as depicted in the embodiment of FIG. 4 may provide a small degree of additional flexibility of the closure 10, allowing an additional albeit small degree of additional flexibility to the tapered circumferential sidewall 34 which may improve the engagement, and hence the seal, with the neck, and more particularly with the exterior circumferential edge thereof.

Figure 5:
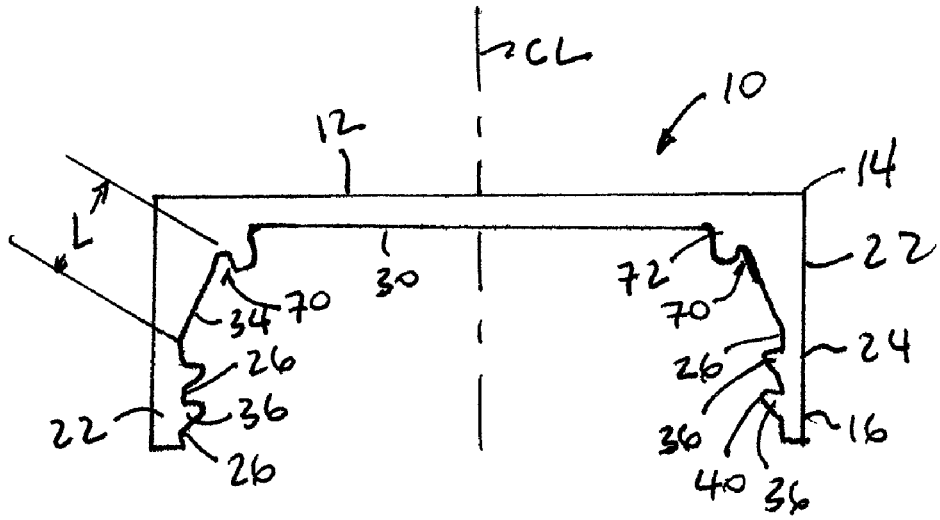
FIG. 5 is a sectional elevational view of a third embodiment of a closure according to the present invention.

FIG. 5 depicts a sectional elevational view of a third embodiment of a closure according to the present invention. The embodiment of the closure 10 according to FIG. 5 is substantially similar to that described with reference to FIGS. 3 and 4, however an inner sidewall 80 is omitted according to the embodiment of FIG. 5 and in its place, a circumferential lobe 72 is provided.

The closure 10 according to FIG. 5 includes top panel 12 having depending from its peripheral edges a circumferential skirt 22 which extends downwardly therefrom. The circumferential skirt includes an exterior skirt sidewall 24, which also can be considered coincident with the sidewall element 16, on the opposite and interior thereof in interior skirt sidewall 26. The interior skirt sidewall has extending inwardly therefrom mating threads 36. Closure 10 also includes an interior top surface 30, and intermediate said interior top surface 30 and the interior skirt sidewall 26 is found a tapered circumferential sidewall 34 as has been previously described. At one end, the tapered circumferential sidewall extends upwardly, that is to say in the direction of the top panel directly from the interior skirt sidewall 26 and tapers inwardly wherein it merges or otherwise intersects a circumferential recess 70 which forms part of the closure 10. One side of the circumferential recess 70 is merged with the tapered circumferential sidewall 34, while the other side merges into the circumferential lobe 72. The circumferential lobe 72 is concentric with the center line "CL" and extends downwardly from the interior top surface 30 and aids in defining the dimensions of the circumferential recess.

Figure 6:
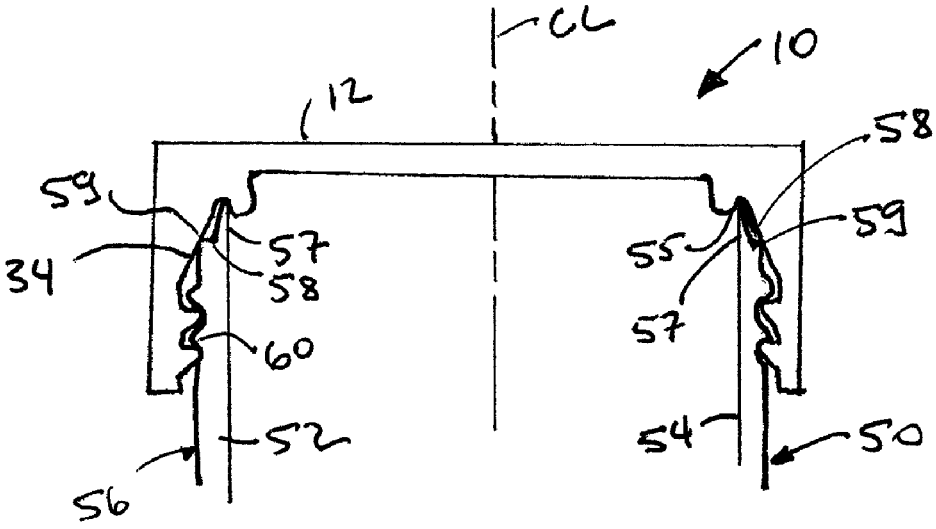
FIG. 6 is a sectional elevational view showing the embodiment of FIG. 5 engaged on a container neck.

FIG. 6 depicts a sectional elevational view of the closure according to FIG. 5 engaged upon the neck 52 of a container 50. As seen in FIG. 6, the neck 52 includes an inner surface 54, an outer surface 56, and having at the ends thereof, a top surface 58. The intersection between the top surface 58 and the outer surface 56 defines an exterior circumferential edge 59 which is adapted to come into physical contact with the tapered circumferential sidewall 34 of the closure 10. Additionally, the embodiment of the neck 52 includes a circumferential fin 57 which extends upwardly from the top surface 58 of the neck and preferably, is dimensioned to be concentric about the center line "CL" of the closure and inwardly of the exterior circumferential edge 59. As is seen, the fin 57 is advantageously dimensioned so that, when the closure 10 is properly engaged upon the neck 52 of the container 50 in order to form a liquid-tight seal therewith, the exterior circumferential edge 59 is urged against, and forms a liquid-tight seal with the tapered circumferential sidewall 34 and concurrently, the fin 57 extends into the circumferential recess 70 and may form an additional liquid-tight seal there between at its point of contact within said circumferential recess. Thus, the embodiment according to FIG. 6 provides a means to provide two liquid-tight seals which, as with the further embodiments disclosed in this application, do not require the use of a liner, seal, elastomer, washer, or the like in order to provide reliable liquid-tight sealing between the container 50 and the closure 10.

Figure 7:
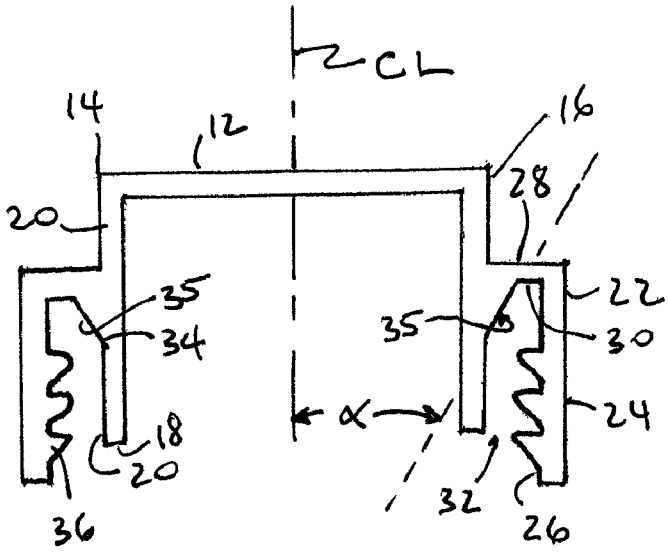
FIG. 7 is a sectional elevational view of a fourth embodiment of a closure according to the present invention.

FIG. 7 provides a sectional elevational view of a closure according to a fourth embodiment according to the present invention. The embodiment of the closure 10 according to FIG. 7 is most similar to that as described with reference to FIG. 1 and includes many common individual elements therewith. However, the embodiment according to FIG. 7 includes a modified form of the circumferential skirt and its dependent elements.

Turning to FIG. 7, there is depicted a closure 10 including a top panel 12 and having depending from the peripheral edges 14 of said top panel 12 a sidewall 16. This circular sidewall includes an exterior face 20 as well as a bottom end 18. Intermediate the peripheral edge 14 and the bottom end 18 of the sidewall 16 is a circumferential skirt 22 which depends from the sidewall 16 and extends outwardly from the exterior face 20 thereof. The circumferential skirt 22 includes an exterior skirt sidewall 24, an interior skirt sidewall 26, an exterior top surface 28, which in this embodiment is essentially perpendicular to the exterior face 20 of the sidewall 16, as well as an interior top surface 30. The region between the region between the interior skirt sidewall 26, the interior top surface 30, and a portion of the sidewall 16 defines a junction space 32 of the closure. Extending inwardly, that is to say towards a concentric central axis of center line "CL", and depending from the interior skirt sidewall are one or more mating threads 36. Also present within the junction space 32 is a tapered circumferential sidewall 34 which, at a point where it intersects with a part of the exterior face 20 of the sidewall 16 within the junction space, tapers outwardly until it intersects the interior top surface 30. As the tapered circumferential sidewall 34 is preferably concentric about the central center line "CL", the tapering face 35 also forms an angle with the center line, which angle "alpha" is desirably between about 5-45°, more preferably is between about 10°-30°, but still more preferably is between about 15°-20°. Thus, a comparison of the embodiment as depicted on FIG. 7 with the embodiment as depicted on FIG. 1 reveals that while many similar elements are present, the positioning of the tapered circumferential sidewall is reversed with respect to that of FIG. 1.

According to the embodiment depicted on FIG. 7, it can be seen that the interior circumferential edge 59 which is the point at the intersection between the top surface 58 and the inner surface 54 of the neck 52, forms a liquid-tight seal by direct contact with the tapered circumferential sidewall 34. Thus, it is seen that the end of the neck 52 and more particularly, the top surface 58 is compressed against the circumferential sidewall 54, albeit the top surface 58 is directed outwardly from the center line CL in such a manner that the a good liquid-tight seal is formed directly therebetween without the need for an intermediate element. With further rotation of the closure 10 on the neck 52 it is expected that the top surface 58 would be further compressed against the circumferential sidewall 34 and displaced away from the center line CL of the closure 10 thus slightly deforming the end of the neck 52 in the region of the top surface 58. Theoretically the actual circumference of the top surface 58 of the neck 52 is increased by such compression as the closure 10 is further engaged or tightened on the neck 52. This is due to the fact that further vertical displacement of the closure 10 in a downward direction, that is to say in the direction of the bottle 50 or other container causes for the presentation of surfaces of the tapered circumferential sidewall 34 which are of increasingly greater circumference as the closure 10 continues to be tightened on the neck, causing both a temporary increase in the diameter of the neck 52 at the region of the top surface 58, and the tapered circumferential sidewall 34.

Figure 8:
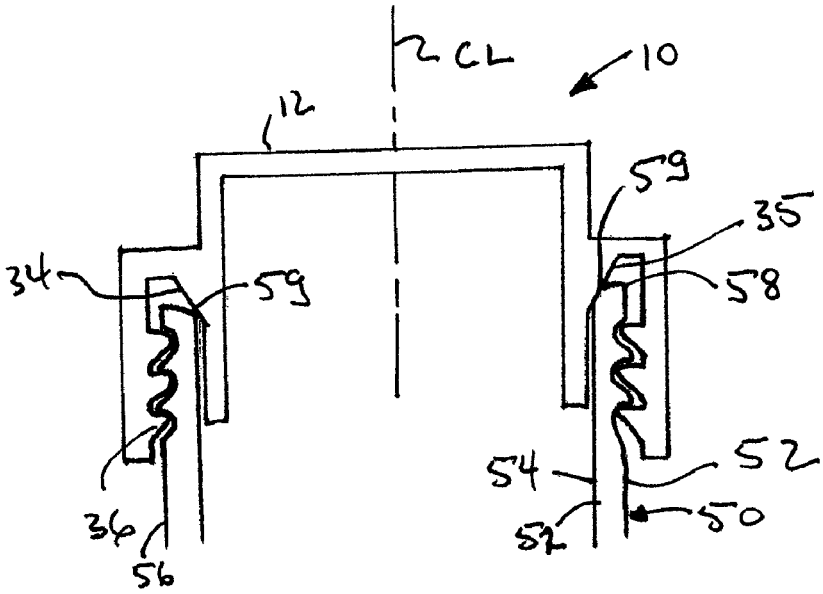
FIG. 8 is a sectional elevational view showing the embodiment of FIG. 7 engaged on a container neck.

FIG. 8 depicts in a sectional elevational view the closure according to FIG. 7 as engaged on the neck 52 of a container 50. As seen in the figure, the corresponding mating threads 60 of the neck 52 of the container engaged with the mating threads 36 of the closure 10. The closure 10 is in full liquid-tight engagement with respect to the neck 52 of the container 50. As can be seen upon a close review, one side, that is the right side of the closure shown in the figure is seen to be in a compressed or flattened relationship of the exterior circumferential edge 59 with the tapering face 35 of the tapered circumferential sidewall 34. The degree of compression shows a small flattened region which is intended to indicate that the region adjacent to the top surface 58 of the neck 52 has been distended outwardly, that is to say away from the center line "CL". On the opposite side, that is to say the left side of the depiction of FIG. 8, it is seen that a lesser zone or region of contact between the exterior circumferential edge 59 of the neck 52 and the tapering face 35 of the tapered circumferential sidewall 34 is achieved yet, a positive and liquid-tight seal contact is made. The depiction in this figure is intended to illustrate the fact, as discussed above, that in actual use many blow-molded bottles suffer from irregularities and non-planar warpage at the open ends of such bottles, that is to say corresponding to the top surface 58 of the necks 52 of such containers 50. Notwithstanding such an irregularity, the closure 10 in arrangement of its particular elements is seen to compensate for such geometric defects in the necks 52 of the containers 50 and yet provide a liquid-tight seal in relationship with the closures absent the use of an intermediate liner, elastomeric washer, or the like. Rather, a resealable liquid-tight seal may be achieved directly between the container 50 and the closure 10 without a separate intermediate element, such as an elastomeric or flexible element interposed between the direct contact points between the container 50 and the closure 10.

It is to be understood that various modifications may be made to the embodiments depicted on FIGS. 1-8 and which are still considered to fall within the scope of the present invention although not particularly illustrated. While the foregoing describes various useful and presently preferred embodiments of the invention, it is understood that variations of the design of the closure 10 are possible and are considered to fall within the scope of the present invention. For example, although not shown, it is contemplated that the position of the mating threads 36 of the closure 10 might also be positioned elsewhere, such as either extending outwardly from the exterior face 20 or alternately, extending inwardly, that is to say towards the center line, from the interior face of the sidewall 16. Indeed, mating threads may be provided on both the inner surface 54 and the outer surface 56 of the neck 52 of a container. Likewise, with regard to the closure, mating threads 36 may be provided on any part thereof which is suitable for engaging with a correspondingly designed or dimensioned container. For example, the mating threads 36 may be provided on either the interior face, or the exterior face 20 of the sidewall 16, or may be provided on both said surfaces, as well as or as an alternate thereto the mating threads 36 may be provided on the exterior skirt sidewall when used with a bottle or other container having suitably dimensioned and designed mating threads.

Additionally, it is to be understood that the use of mating threads is not required rather, any other removeably affixable and cooperative elements may be used such as snap-type connector or a suitably dimensioned flanged or bayonet-type connection may be used. It is only required that a liquid-tight seal be formed directly between a portion of the container, and the closure positioned within the closure, be formed without a separate intermediate element, such as an elastomeric or flexible element interposed between the direct contact points between the container 50 and the closure 10. Additionally, the exterior top surface 28 of the closure may be interrupted with one or more perforations if so desired to provide either a consumer-attractive appearance, or improved drainage. Further elements to improve the handling or gripability of the container and/or the closure are contemplated; for example, the knurls, ribs, or other features may be provided on any of the exterior surfaces of the closure, such as extending outwardly from the sidewall, and/or extending outwardly from the exterior skirt sidewall 24 of the circumferential skirt 22. Still further, while shown in the figures as being essentially flat, the shape of the surface of the tapered circumferential sidewall 34 adapted to contact the container 50 or neck thereof 52 may be of a different configuration, e.g, curved such as concave or convex and indeed may have a more complex or geometrically convoluted profile than as shown in the Figures.

It can be readily seen from the foregoing that the present invention provides a novel and a particularly effective container and a linerless closure combination which provides not only an initial liquid-tight seal upon the initial sealing of the closure onto the container, but also upon repeated uses and resealing of the closure onto the container.

The present invention also contemplates a method of resealing a sealable container by providing a lineless closure as described herein and utilizing it with the container.

It is also obvious that many further changes and modifications can be made in this invention without departing from its scope and spirit which is only limited by the following claims.

The invention claimed is:

1. A linerless closure mounted on a blow-molded container, the blow-molded container comprising a neck, said neck having an outer surface, a top surface and an edge defined by the intersection of the outer surface and the top surface, the closure comprising; a closure top having depending therefrom a sidewall which terminates at a bottom end, the sidewall having an exterior face from which depends a circumferential skirt which extends outwardly from the sidewall having an interior skirt sidewall and an interior top surface which defines a junction space between the exterior face and the skirt, wherein the junction space includes a tapered circumferential sidewall extending between the interior top surface and the interior skirt sidewall, and wherein the junction space defines a frusto-conical cavity, wherein said closure excludes any flexible or elastomeric intermediate element which is not integrally molded for formed as a part of the closure, said closure top mounted on a container, wherein the edge defined by the intersection of the outer surface and the top surface of the neck is directly compressed against the circumferential sidewall forming a sole liquid-tight seal between the closure and the blow-molded container and wherein the edge is within the frusto-contical cavity.

2. A linerless closure mounted on a blow-molded container according to claim 1, wherein the intermediate element is a gasket, washer, or seal, which is flexible or elastomeric in nature.

3. A linerless closure mounted on a blow-molded container according to FIG. 1, wherein the tapered circumferential sidewall forms an angle with respect to the center line of the closure.

4. A linerless closure mounted on a blow-molded container according to claim 3, wherein the angle is between about 5°-45°.

5. A linerless closure mounted on a blow-molded container according to claim 3, wherein the angle is between about 5°-30°.

6. A linerless closure mounted on a blow-molded container according to claim 3, wherein the angle is between about 10°-25°.

7. A linerless closure mounted on a blow-molded container according to claim 1, wherein the interior skirt sidewall comprises mating threads.

8. A linerless closure mounted on a blow-molded container according to claim 1, wherein the closure further comprises a set of mating threads, and the container further comprises a set of mating threads which are adapted to be engaged with the said mating threads of the closure.

9. A linerless closure mounted on a blow-molded container according to claim 1, wherein the cap further comprises a circumferential recess which is integrally formed as part of the closure.

10. A method of resealing a sealable container by providing a linerless closure mounted on a blow-molded container according to claim 1, and removably mounting said closure upon the neck of said container to provide a seal-tight contact between the closure and the neck, wherein the closure excludes any flexible or elastomeric intermediate element which is not integrally molded or formed as a part of the closure.

11. A linerless closure mounted on a blow-molded container according to claim 1, wherein the neck of the blow-molded container includes a terminal end which is irregular or non-planar.

12. A linerless closure mounted on a blow-molded container according to claim 1, wherein the top surface of the neck of the blow-molded container is undulated.

* * * * *